US005555611A

United States Patent [19]

Lyczek

[11] Patent Number: 5,555,611

[45] Date of Patent: Sep. 17, 1996

[54] APPARATUS FOR REMOVING BOWED DISTORTIONS IN RUNNING TEXTILE WEB

[76] Inventor: Edmund K. Lyczek, 428 Qail Ridge Dr., Spartanburg, S.C. 29303

[21] Appl. No.: 467,867

[22] Filed: Jun. 6, 1995

[51] Int. Cl.[6] ..... D06H 3/12; D06C 3/06

[52] U.S. Cl. ..... 26/102; 26/51.5

[58] Field of Search ..... 26/51.4, 51.5, 26/101, 102, 103, 51, 70, 97, 99; 226/197, 199, 18, 21, 20

[56] References Cited

U.S. PATENT DOCUMENTS

| | | | |
|---|---|---|---|
| 2,496,312 | 2/1950 | Robertson | 26/51.5 |
| 2,968,856 | 1/1961 | Allen | 26/51.5 |
| 3,193,688 | 7/1965 | Morton et al. | 26/51.5 |
| 3,402,443 | 9/1968 | Leitner et al. | 26/51.5 |
| 3,719,975 | 3/1973 | Illarionov et al. | 26/51.5 |
| 4,305,184 | 12/1981 | Woythal | 26/51.5 |
| 4,410,122 | 10/1983 | Frye et al. | 26/103 |

FOREIGN PATENT DOCUMENTS

| | | | |
|---|---|---|---|
| 339166 | 8/1959 | Switzerland | 26/102 |

*Primary Examiner*—Amy B. Vanatta

[57] ABSTRACT

An apparatus consisting of two stationary plates, at least two idle rolls with their shafts mounted to stationary plates, two separate servo drives, and a plurality of weft sensors comprising a bow roll having its shaft made of two pieces spliced rotatably in the middle of the bow roll, so the ends of the bow roll shaft can be rotated independently about the splicing spot.

3 Claims, 1 Drawing Sheet

APPARATUS FOR REMOVING BOWED DISTORTIONS IN RUNNING TEXTILE WEB

BACKGROUND OF THE INVENTION

The invention relates to correcting the weft distortions which occur in fabrics during different working cycles. These distortions are eliminated, usually before the fabric is dried by employing various design straightening devices, often with automatic control.

In general, the straightening devices can be divided into two categories: passive—without sensing the angle of weft distortion, where the straightening device is driven by passing fabric, and active—where the straightening device is driven by auxiliary drives in accordance to signals from weft distortion sensing devices called weft sensors.

Work principle of the first category relies on stretching the fabric in the lateral direction with as little as possible longitudinal tension, thus all kinds of weft distortion including bow distortion can be removed, but not completely. Non-stretching, loose weave fabrics can be straightened, and other fabrics with a dense weave and elastic fabrics sometimes need to be overcorrected to get rid of the distortions permanently. Most straightening devices from the second category employ bow rolls for removing bow distortions.

They can remove only distortions which are symmetrical in respect to the middle of the web, but fail to remove partial bow distortions. Other machines using curved cylinders or plurality of axially extending, pivotally mounted flexible rods (disclosed in U.S. Pat. No. 4,768,265) can better handle unsymmetrical web distortions, but they are not popular because of their large dimensions and many moving parts.

It is an object of the present invention to improve the apparatus employing bow rolls, so it would be suitable for removing bowed weft distortions in the fabric, especially partial bow distortion, often called a hook.

SUMMARY OF THE INVENTION

According to the present invention an apparatus is provided consisting of two stationary plates, at least two idle rolls with their shafts mounted to the stationary plates, two separate servo drive means mounted to said stationary plates, comprising a bow roll having its shaft made of two pieces spliced rotatably in the middle of the bow roll defining a splicing spot, so the ends of the bow rolls shaft can be rotated independently about the splicing spot. Further, the apparatus, according to the present invention, including plurality of weft sensor means located latterally in front of the running textile web, after the bow rolls, in respect to the textile web's running direction, wherein the weft sensor means are arranged in pairs located on the same side of the textile web. Signals from said weft sensors means are used for controlling the respective servo drives which rotate the shafts of the bow rolls in order to remove bowed distortions from the textile web.

DESCRIPTION OF THE PREFERRED EMBODIMENT

Figure 1:
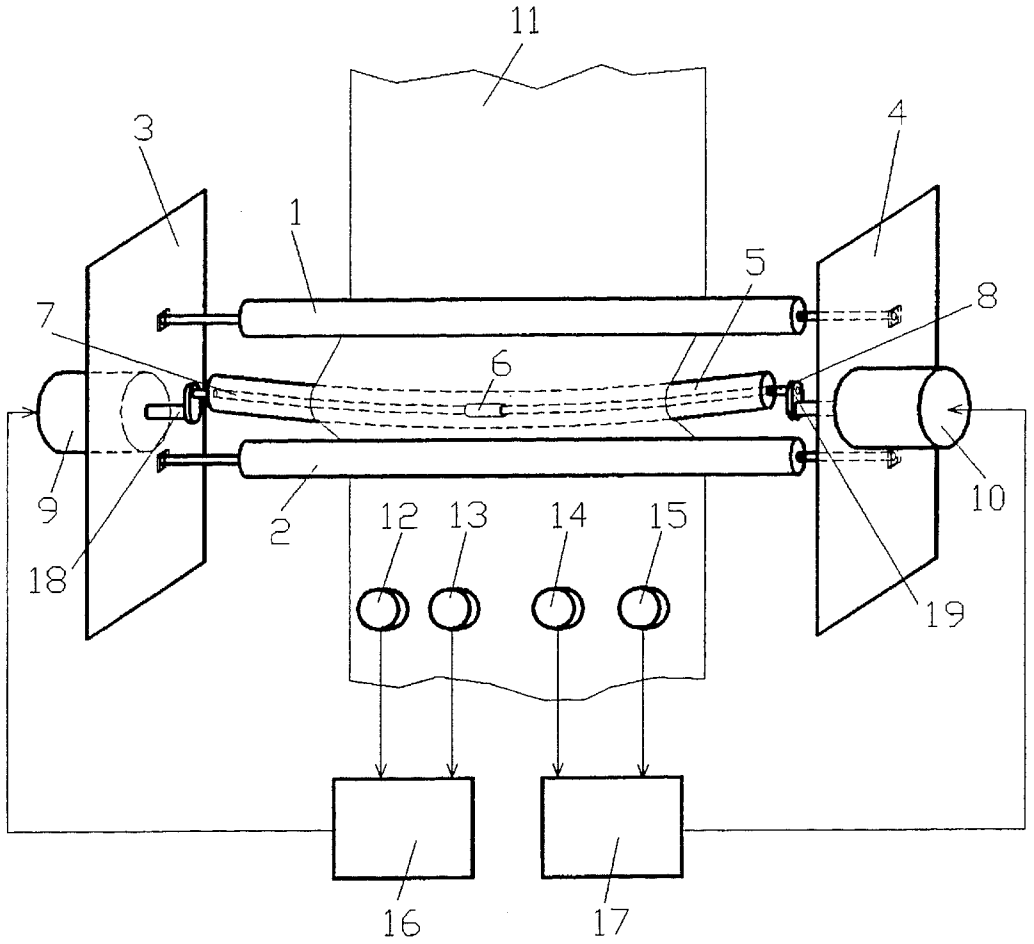
FIG. 1 is a diagrammatic view of the preferred embodiment of the present invention

Referring to FIG. 1 two idle rolls 1, 2 have ends of their shafts mounted to stationary plates 3,4. The bow roll 5 having its shaft made of two pieces 7,8 which are spliced rotatably in the middle of the bow roll 5, in the splicing spot 6. The end of the bow roll 5 shaft 7 is attached to a cranked output shaft 18 of a servo drive 9 which is mounted to the plate 3. The other end of the bow roll 5 shaft 8 is attached to a cranked output shaft 19 of a servo drive 10 which is mounted to the plate 4. The attachment spots of the bow roll shafts 7,8 to the cranked output shafts 18, 19 of the servo drives 9,10 are offset by a certain distance from the centers of the cranked output shafts 18, 19 of the servo drives 9,10, so the splicing spot 6 stays in the same place all the time during rotation of the bow roll shafts 7,8.

Textile web 11 is passing between the idle rolls 1,2 and the bow rolls 5, partially wrapping said rolls, preferably symmetrically in regard to the splicing spot 6.

After passing the above described arrangement of the idle rolls and the bow roll, the textile web passes in front of weft sensors 12, 13, 14, 15. Said weft sensors are arranged across the textile web in pairs located on the same side of the textile web 11 in regard to the middle of the textile web 11.

Signals from the weft sensors 12,13 located on the same side of the textile web 11 are combined in a circuitry 16 according to known method to produce an output signal which is supplied to the input of the servo drive 9 for the purpose of automatic control of the position of the bow roll's 5 shaft 7 in order to alter the length of the textile web's path, thus removing bowed distortion from that side of the textile web 11 until combined signal from the weft sensors 12, 13 reaches its zero value.

Likewise, signals from the weft sensors 14, 15 located on the other side of the textile web 11 are combined in a circuitry 17 to produce an output signal which is supplied to the input of the servo drive 10 for the purpose of automatic control of the position of the bow roll's 5 shaft 8 in order to alter the length of the textile web's path, thus removing bowed distortions from that side of the textile web 11 until combined signal from the weft sensors 14, 15 reaches its zero value.

I claim:

1. An apparatus for removing bowed distortions in moving textile web including two stationary plates, at least two idle rolls having ends of their shafts mounted to the stationary plates, first servo drive means mounted to one stationary plate, second servo drive means mounted to the other stationary plate, a plurality of weft sensor means located in front of the textile web, and comprising: a bow roll having its shaft made of two pieces spliced rotatably in the middle of the bow roll defining a splicing spot, wherein one end of the bow roll's shaft is attached to a cranked output shaft of the first servo drive means, while the other end of the bow roll's shaft is attached to a cranked output shaft of the second servo drive means for rotating said shafts independently about the splicing spot.

2. An apparatus according to claim 1 wherein the weft sensor means are arranged across the textile web in pairs located on the same side of the textile web with respect to the middle of the web and signals from said weft sensor means located on the same side of the textile web are combined and used for the purpose of automatic control of the position of the bow roll shafts via the corresponding servo drive means located on the same side of the textile web.

3. An apparatus according to claim 1 wherein the moving textile web partially wraps the idle rolls and the bow roll, symmetrically with regard to the splicing spot.

* * * * *